US005476429A

United States Patent [19]

Bigelow et al.

[11] Patent Number: 5,476,429

[45] Date of Patent: Dec. 19, 1995

[54] TREADMILL FOR USE WITH A WHEELCHAIR

[75] Inventors: Clifford C. Bigelow; Jerome V. Eck, both of Naperville; Terry N. Layton, Arlington Heights, all of Ill.

[73] Assignee: Packer Engineering Inc., Naperville, Ill.

[21] Appl. No.: 251,254

[22] Filed: May 31, 1994

[51] Int. Cl.[6] ..... A63B 22/02

[52] U.S. Cl. ..... 482/54; 482/904; 414/921

[58] Field of Search ..... 482/54, 904, 61, 482/148, 133, 134, 135, 136, 137; 73/117; 414/921; 187/200, 245

[56] References Cited

U.S. PATENT DOCUMENTS

| | | | |
|---|---|---|---|
| 1,155,126 | 9/1915 | Bond . | |
| 2,923,149 | 2/1960 | MacMillan . | |
| 2,979,942 | 4/1961 | Allen . | |
| 3,180,138 | 4/1965 | Hundley . | |
| 3,643,943 | 2/1972 | Erwin, Jr. et al. . | |
| 3,803,909 | 4/1974 | Ostrander | 73/117 |
| 4,026,388 | 5/1977 | Creissels | 187/245 |
| 4,389,056 | 6/1983 | Tenniswood . | |
| 4,564,086 | 1/1986 | Kingston | 414/921 |
| 4,565,385 | 1/1986 | Morford . | |
| 4,641,996 | 2/1987 | Seal | 187/245 |
| 4,765,614 | 8/1988 | Shute . | |
| 4,846,156 | 7/1989 | Kopnicky . | |
| 4,911,425 | 3/1990 | Kynast et al. . | |
| 4,942,762 | 7/1990 | Schober et al. | 73/117 |
| 4,966,362 | 10/1990 | Ramaekers | 482/54 |
| 5,052,521 | 10/1991 | Wendt et al. | 414/921 |
| 5,125,481 | 6/1992 | Shibata | 187/245 |
| 5,143,181 | 9/1992 | Bixby | 187/245 |
| 5,231,870 | 8/1993 | Fukuda et al. | 73/117 |
| 5,331,701 | 7/1994 | Chase et al. | 414/921 |

FOREIGN PATENT DOCUMENTS

| | | |
|---|---|---|
| 2226658 | 4/1973 | France . |
| 3304707A1 | 10/1983 | Germany . |

*Primary Examiner*—Richard J. Apley
*Assistant Examiner*—Lynne A. Reichard
*Attorney, Agent, or Firm*—James A. Geppert

[57] ABSTRACT

An exercise device for the occupant of a wheelchair acting as a treadmill which may be used for cardiac stress testing, cardiac or stroke rehabilitation, fitness training, aerobic training or educational/physical games, with the device including a generally inclined ramp having parallel sides, a forward entrance portion, a movable dolly mounted on rails on the sides of the ramp, the dolly having a pair of laterally movable caster capture plates with openings to receive the front casters of a wheelchair and angular rods cooperating with the wheelchair drive wheels acting to adjust the lateral spacing of said plates, locking means for the dolly to retain it in its forward position, separate locking means for locking the dolly in its rearward position when a wheelchair has been moved onto the ramp into operative position, a pair of enlarged openings adjacent the rear edge of the ramp, and a pair of longitudinally movable rollers beneath the ramp and movable between a rear retracted position allowing the wheelchair drive wheels to be partially received in the openings and a forward position under the drive wheels to engage and lift the drive wheels so that the user can manually rotate the wheelchair drive wheels to rotate the rollers and provide signals to a control apparatus for the desired type of training, testing or rehabilitation.

30 Claims, 7 Drawing Sheets

TREADMILL FOR USE WITH A WHEELCHAIR

TECHNICAL FIELD

The invention disclosed herein relates to an aerobic fitness training device for wheelchair occupants which may be used for stress testing, rehabilitation, fitness training or educational (physical) games.

BACKGROUND

Exercise equipment for the development of fitness, such as bicycles, treadmills, weight machines and free weights, has become widely used by the general public for fitness programs either at home or in fitness centers, such as health clubs and YMCAs. Such programs are utilized for purposes of stress testing, rehabilitation from heart attacks and strokes, and/or aerobic training. However, very little attention has been given to the use of such equipment for those who are disabled in any manner, such as being confined to a wheelchair, even though those persons whose primary mode of mobility is the manually operated wheelchair and have a need for exercise, fitness training, stress testing and the like. One would expect that wheelchair occupants will have more highly developed muscles of the arms, wrists and shoulders than the average person, however, such development is necessitated by the propelling of the wheelchair to move from place to place and may not be the most efficient and desirable exercise program for that person.

It has been demonstrated that a wheelchair ergometer can be used to effectively stress test the lower limb disabled population. Further, it has been recognized that the current testing modality, namely arm crank ergometers, have various shortcomings. Some of these shortcomings include that the ergometer does not allow the patient to utilize his/her normal mode of locomotion to assess the patient's physical fitness status; does not allow for the independent concurrent assessment of the right and left sides of the patient; and requires the patient to assume an awkward position during testing.

Of particular interest to this problem is the Kynast et al. U. S. Pat. No. 4,911,425 entitled "Wheelchair User Exercise Device", issued Mar. 27, 1990. This patent discloses a manually operated wheelchair user exercise device having a pair of laterally spaced, parallel ramps, each ramp including an open front end and a barriered rear end; wherein the ramps are jointly tiltable between a downwardly inclined forwardly facing position and a level position. Each ramp is provided at its rear end with a set of three rollers that are flywheel-effect equipped and are exposed in the base of the ramp. A manually operated mechanism simultaneously tilts the ramps between the tilted wheelchair receiving position and an operative level position once the wheelchair is backed onto the ramps and rests on the roller sets. At this point the front casters are braked and the user can manually actuate the rear wheels for exercise purposes.

This structure has several disadvantages for the user; namely, the manual operation of the tilting device for shifting the ramps between their tilted, wheelchair receiving position and the level testing position; the slope of the tilted position of the ramps resulting in a slippage problem as the wheelchair user attempts to back the chair onto the ramps; the pair of ramps receiving the wheelchair; the plurality of rollers supporting the wheelchair drive wheels at the rear end of each ramp; and the lack of adaptability of the assembly to wheelchairs of differing widths and differing cambers of the varying diameter large drive wheels of the wheelchair. Also, the caster capture system of this design lacks adequate lateral adjustability to accommodate the majority of wheelchairs, and the ramp widths limits the ability of the system to accommodate wheelchairs with larger dimensional differences between the drive wheel and caster track widths. The present invention, on the other hand, relates to an improved exercise arrangement for a wheelchair occupant which would allow that person to exercise and test the functional capacity of his cardiovascular system using his own wheelchair.

DISCLOSURE OF THE INVENTION

The present invention relates to an aerobic fitness training device for the use of a wheelchair occupant which will provide a means for assessing the cardiovascular fitness of lower-limb disabled patients that is safe, durable and reliable, and will accommodate most commercially available wheelchairs. The design allows for variation in rear drive wheel diameter, front caster diameter and drive wheel camber, and the design will accommodate wheelchairs which have larger dimensional differences between the drive wheel and caster track widths. The arrangement provides a treadmill effect for a wheelchair by utilizing a mechanical and electrical device for continued manual user activity of the wheelchair in a stationary position. The mechanical portion of the device allows the continuous rotation of the rear drive wheels of the wheelchair by the occupant when positioned on a single roller in the device for each drive wheel. The electrical portion of the device consists of instruments and components to measure velocity and directionality of the wheelchair, methods to apply resistance to the rollers, and a computer system.

The present invention further relates to a novel wheelchair aerobic fitness training and testing device wherein the major systems of the arrangement include a ramp allowing for the movement of the wheelchair onto the testing and training device, a large roller system for supporting the rear drive wheels of the wheelchair to allow rotation of the large wheels for exercise and testing, a caster capture system for the front casters of the wheelchair, electronics and instrumentation for control of the testing of the device and hardware/software to be used in a computer for the functions of testing and training of the fitness of the occupant of the wheelchair on the device. The system design of the ramp for the movement of the wheelchair onto the device and the caster capture system allows for ease of usage by the occupant and is universal in design to accommodate substantially all wheelchairs. Also, the single roller configuration of the system is unique in design for both proper placement of the wheelchair on top of the rollers during testing/training and to accommodate cambered and varying diameter wheelchair drive wheels.

BEST MODE FOR CARRYING OUT THE INVENTION

Figure 1:
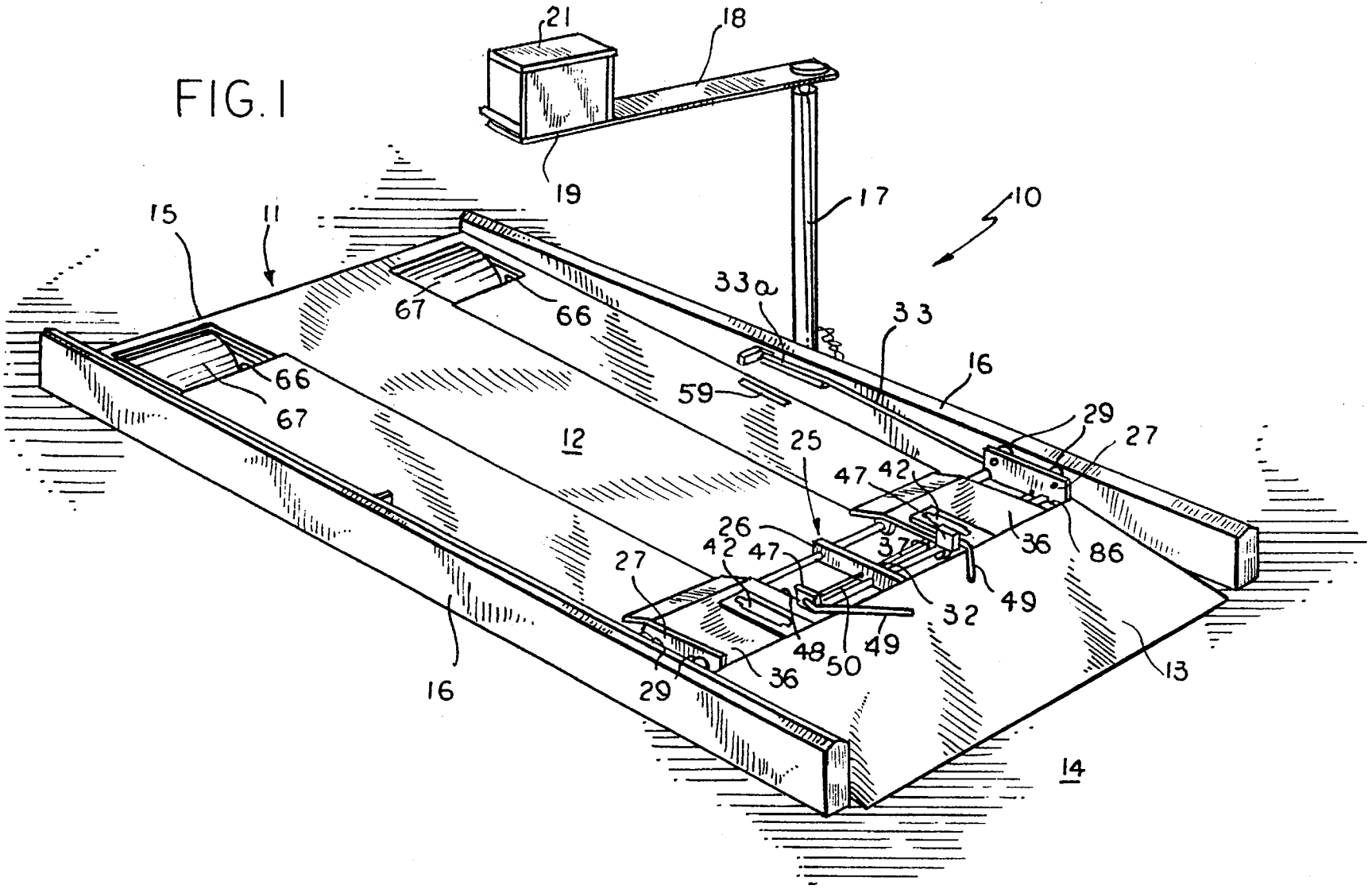
FIG. 1 is a perspective view of the wheelchair fitness training device absent a wheelchair.
Figure 2:
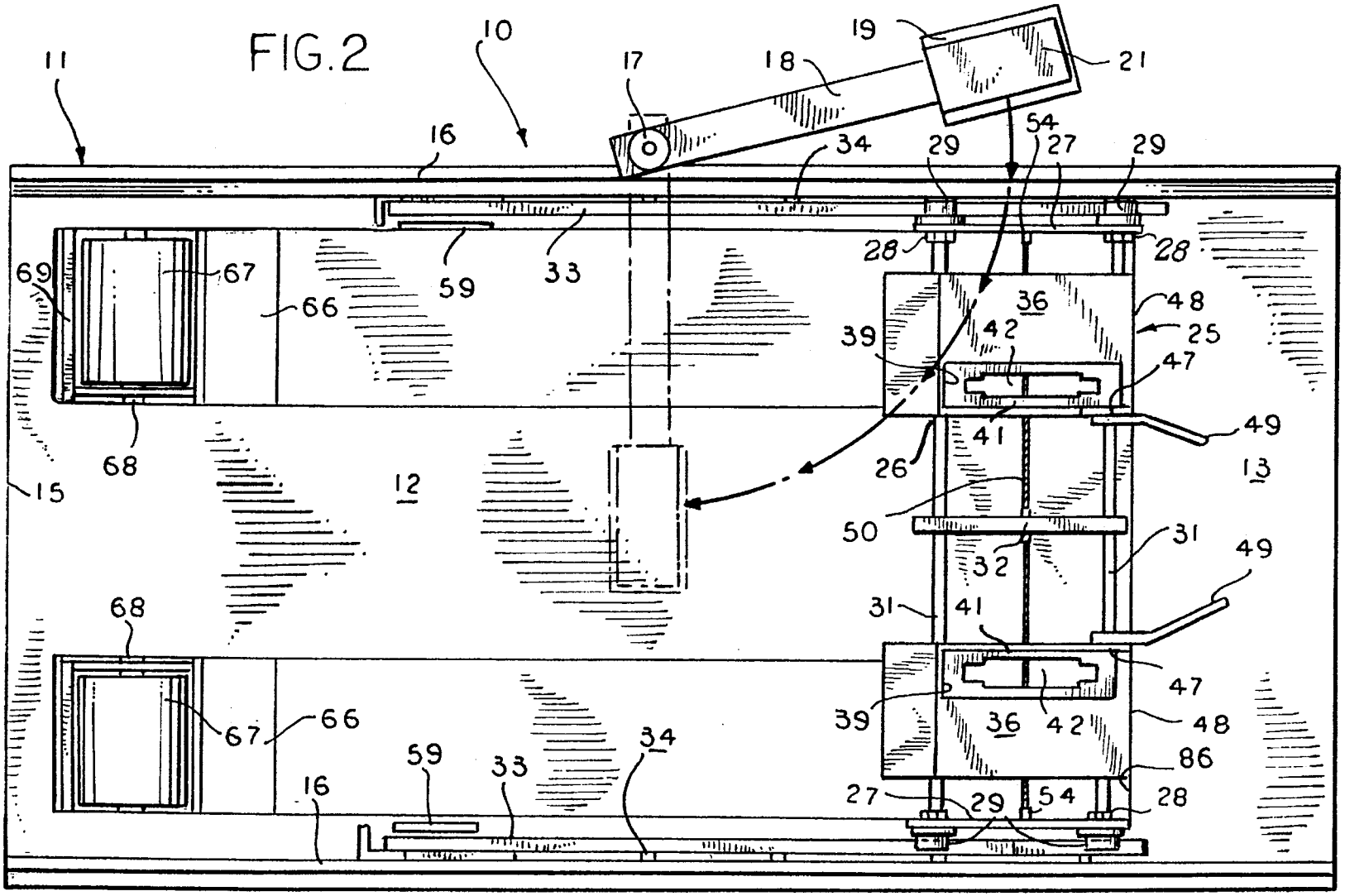
FIG. 2 is a top plan view of the fitness training device of FIG. 1.
Figures 3, 4:
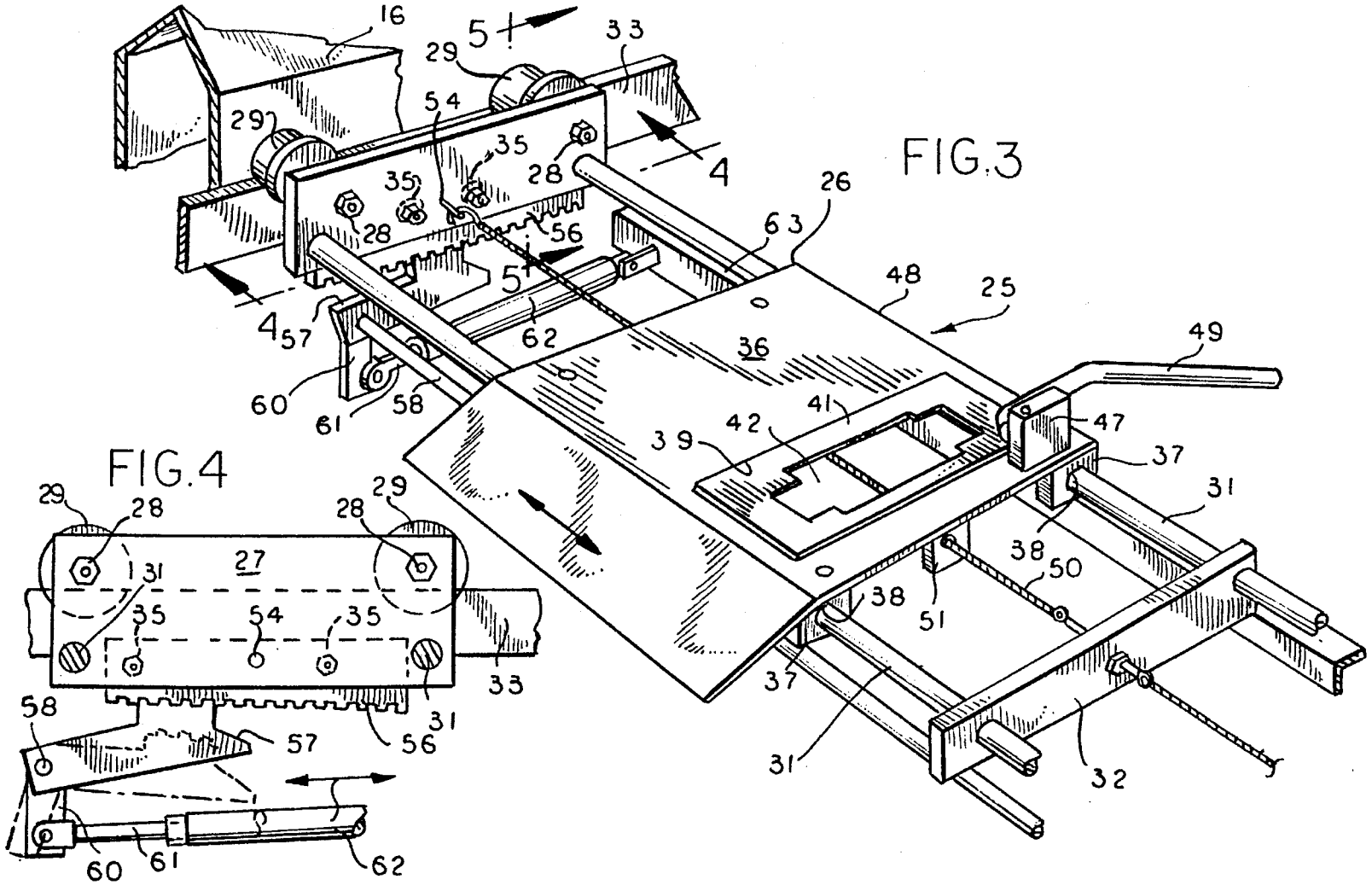
FIG. 3 is a partial enlarged perspective view of a portion of the caster capture system for the trainer.
FIG. 4 is a vertical cross sectional view of the caster capture system taken on the line 4—4 of FIG. 3.
Figure 5:
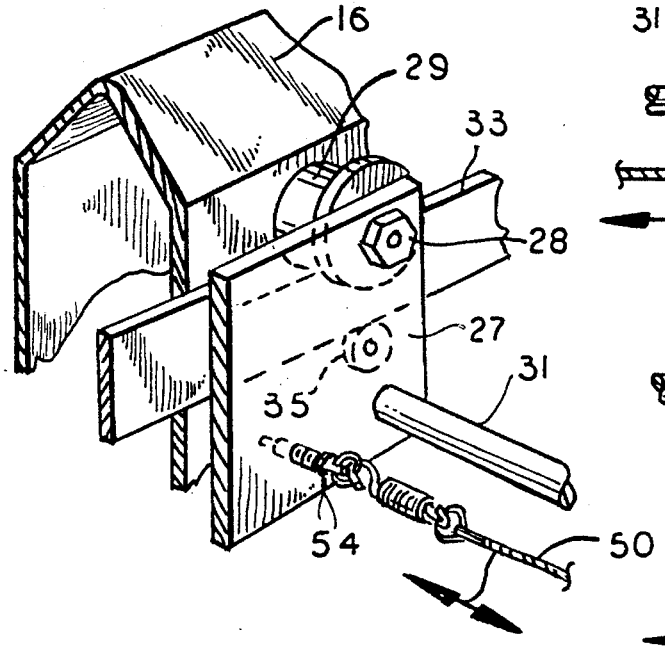
FIG. 5 is a vertical cross sectional view taken in perspective on the line 5—5 of FIG. 3.
Figure 6:
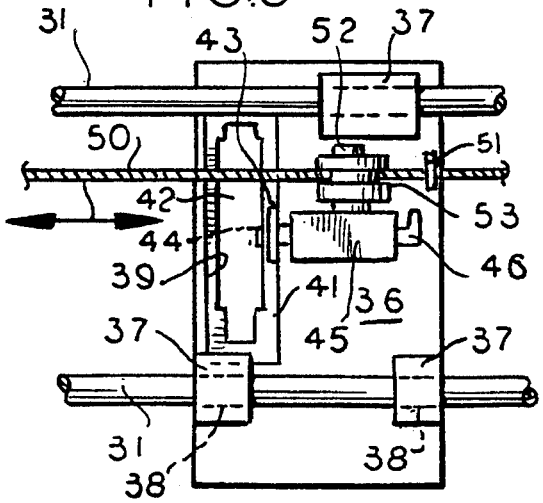
FIG. 6 is a bottom plan view of a caster capture plate of the caster dolly which receives the wheelchair caster.
Figure 7:
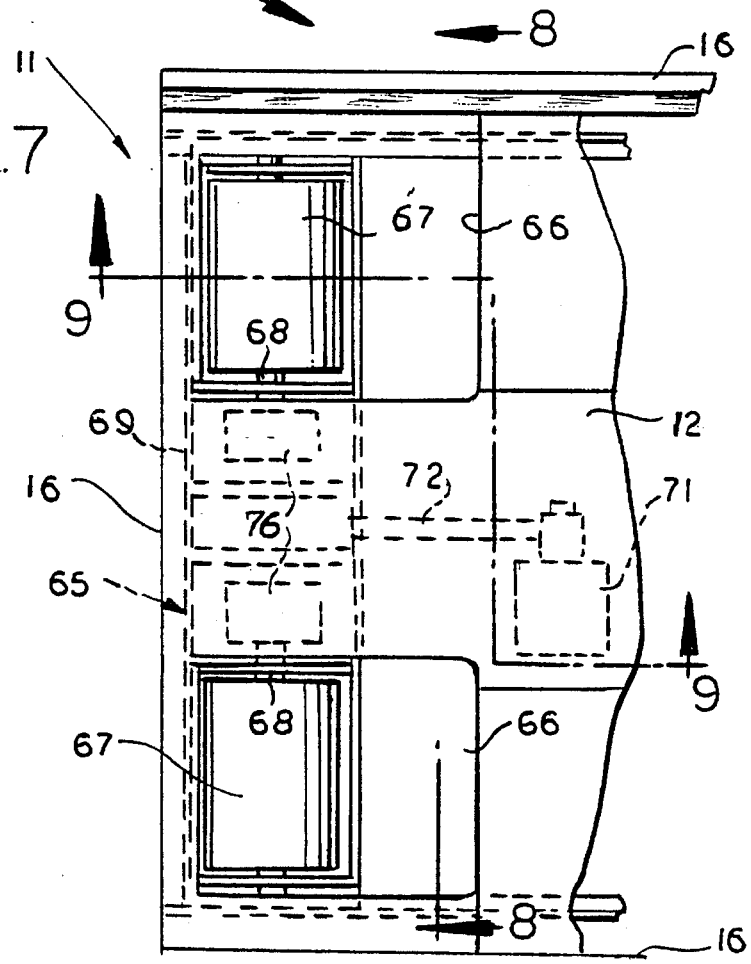
FIG. 7 is a top plan view of the rear portion of the fitness training device showing the support rollers for the wheelchair drive wheels in their retracted position.
Figure 8:
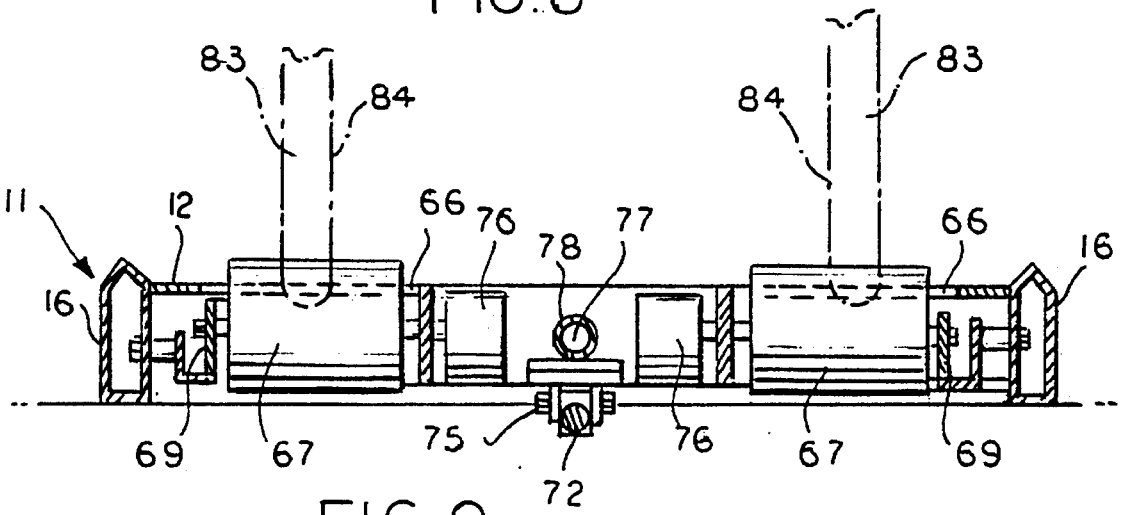
FIG. 8 is a vertical cross section view of the roller assembly taken on the line 8—8 of FIG. 7.

Referring more particularly to the disclosure in the drawings wherein is shown an illustrative embodiment of the present invention, FIGS. 1 and 2 disclose a wheelchair fitness training device 10 having the function of a treadmill for continuous manual user activity of a wheelchair 82 in a stationary position, wherein the device includes a ramp system 11, a caster capture system 25 and a roller system 65.

Ramp System

Figure 15:
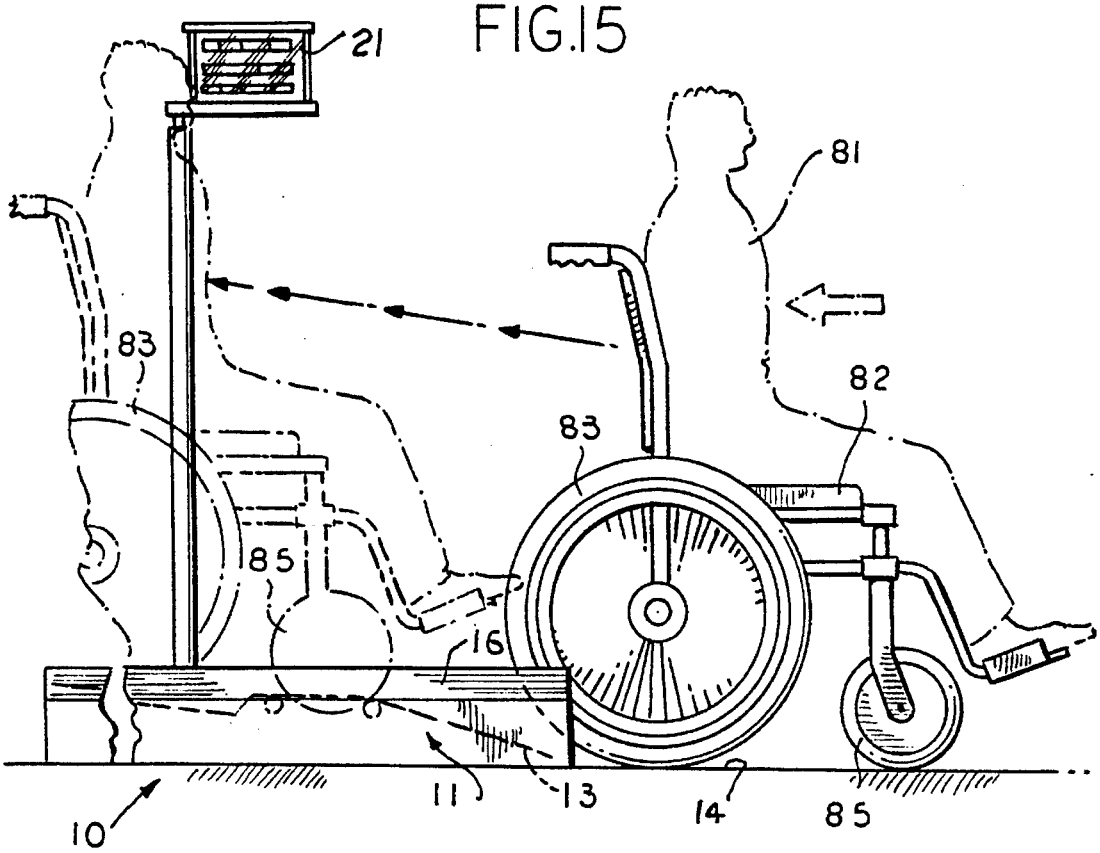
FIG. 15 a side elevational view of the fitness training device showing a wheelchair and its occupant initially moving onto the device.
Figure 16:
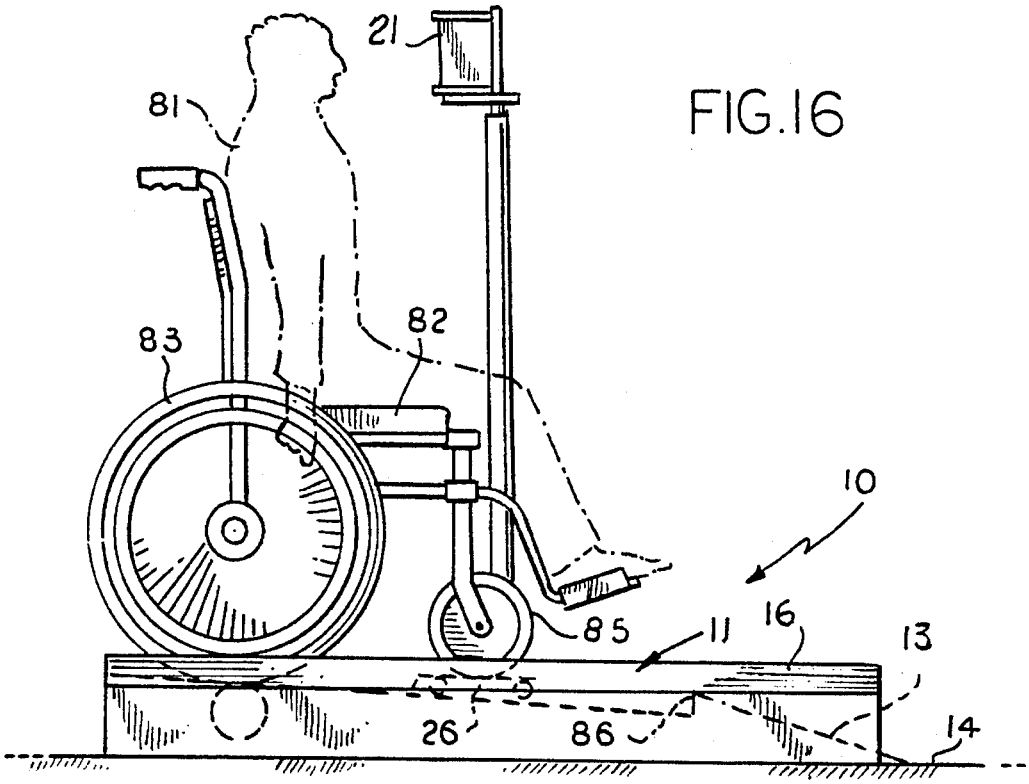
FIG. 16 is a side elevational view similar to FIG. 11 but showing the wheelchair in its operative position on the device.

The ramp system 11 comprises an inclined ramp base or floor 12 extending between the rear edge 15 to a forward entrance portion 13 extending from the ramp base to the ground 14 to receive a wheelchair 82 (see FIGS. 15 and 16). The inclined base 12 is provided with a slope of approximately five degrees, which slope will allow for accessibility by many quadriplegics. Upstanding generally parallel sides 16,16 on the base extend between the rear edge 15 and the entrance portion 13. Attached to one side 16 is a vertical post 17 terminating in a swingable arm 18 carrying a platform 19 at its end to support a computer or other controls 21 communicating with the computer for the trainer.

The ramp system has been designed to fit into most smaller research laboratories, and the ramp slope, length, size and location were optimized to provide a minimum slope, accessible by many quadriplegics while holding the ramp length within a treadmill type of footprint. The ramp system provides a solid base on which the wheelchair occupant can propel his/her wheelchair.

Caster Capture System

The caster capture system 25 comprises a dolly 26 including a pair of side plates 27 having spaced stub axles 28 mounted therein to support a pair of spaced upper cam followers 29 moving on an elongated rail 33; a pair of lateral parallel rods 31 extending between and secured in the side plates 27 and supporting a centrally located plate 32. Each ramp side 16 is provided with a rail 33 having an initial sloping portion slightly greater than the slope of the ramp base and a horizontal portion 33*a* acting to lift the dolly and casters and provide the wheelchair with a level position when the wheelchair has been fully backed onto the ramp; the rail 33 being secured to the side 16 by bolts and spaced sleeves 34 to extend along a substantial portion of the length of the ramp system 11. A second set of spaced lower cam followers 35 are mounted on axles mounting toothed plates 56 onto each side plate 27 to ride on the underside of each rail 33 to prevent any skewing or unauthorized movement of the dolly during placement of the wheelchair on the ramp.

Mounted on the rods for lateral movement are a pair of caster capture plates 36 having depending ears 37 with openings 38 receiving the rods 31 to allow movement of the plates in the dolly 26, and each plate 36 has a rectangular opening 39 to receive a caster plate insert 41 with an appropriate opening 42 to receive the front caster 85 of a wheelchair 82. Each caster plate 41 has a depending ear 43 with an opening 44 therein to receive a spring-loaded plunger 46 projecting from a block 45 mounted on the underside of the capture plate 36; the plunger being manually retracted and released to allow release or locking of the plate insert 41 within the opening 42. An upwardly extending ear 47 on the inner front edge 48 of each caster capture plate 36 has a forwardly and then inwardly angled positioning rod 49 for a purpose to be explained later.

As seen in FIGS. 2, 3, 5 and 6, a cable 50 extends across the dolly 26 and through ears 51 depending from the plates 36 to the side plates 27, with each caster capture plate 36 having a pulley 53 mounted on a stub shaft 52 on block 45 for the cable 50 to pass thereover. The cable is secured to the central plate 32 and terminates at its outer ends in spring loaded pins 54,54 which are mounted in the side plates 27 and project into corresponding openings in the rails 33; the pins 54 acting to lock the dolly 26 in its forward position on the ramp until a wheelchair is properly positioned with its casters 85 in the openings 42 in the plate inserts 41 on the dolly for movement toward the rear of the ramp.

Alongside each side plate 27 is a toothed plate or rack 56 secured thereto to cooperate with a pivotal arm 57 having corresponding teeth mounted on a rotatable rod 58 underneath the base 12 and extending laterally across the ramp for rotation therewith; the toothed portion of the arm 57 adapted to project through a slot 59 in the ramp base to engage the plate 56. A lever 60 is also secured onto the rod 58 for actuation by a piston 61 and cylinder 62 mounted on a stationary cross beam or bar 63 under the ramp. The rack 56 and toothed plate 57 cooperate to lock the caster capture system 25 in its rearward position when the wheelchair is operatively positioned on the ramp for training or testing.

Roller System

Figure 13:
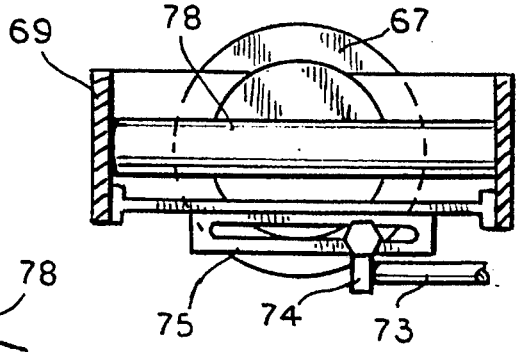
FIG. 13 is a vertical cross sectional view taken on the line 13—13 of FIG. 11.
Figure 14:
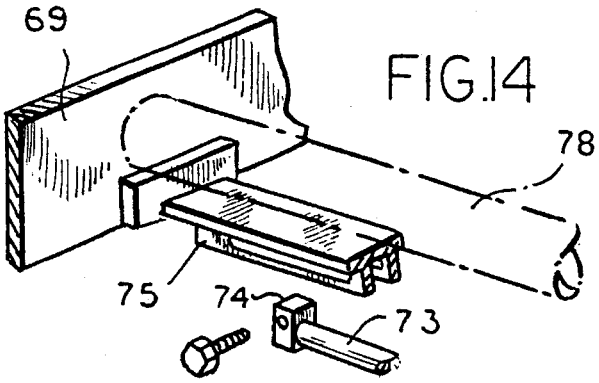
FIG. 14 is a partial perspective view of the guide tube and mounting bracket for the linear actuator for the roller assembly.

Located adjacent the rear edge 15 of the ramp base 12 are a pair of laterally spaced enlarged rectangular openings 66 for the roller system 65; the openings being adapted to receive the rear large drive wheels of a wheelchair to limit rearward movement of the wheelchair on the ramp. Each opening 66 encompasses a large roller or drum 67 having a diameter in the range of 6 to 8 inches located on a roller shaft 68 received in a longitudinally movable roller housing 69; the housing having cam followers 70 moving on corresponding rails in the ramp (not shown). Each roller 67 has a portion of its surface extending above the ramp base 12 to contact and support the drive wheel of a wheelchair when the wheelchair is properly positioned on the ramp. The rollers in their housing are normally positioned towards the rear edge 15 of the ramp by a linear actuator comprising a motor 71 driving a threaded shaft 72 received in an internally threaded tube 73; rotation of the shaft acts to longitudinally move the tube and shift the roller system 65 from the rearmost position seen in FIG. 9 to a forward position under the drive wheels of the wheelchair seen in FIG. 10. The forward end 74 of the tube is secured onto a mounting bracket 75 (see FIGS. 13 and 14) on the roller housing 69. A magnetic particle brake 76 is incorporated on each roller shaft 68 suitably mounted in the ramp to provide braking resistance proportional with brake input voltage and independent of roller speed. The roller shafts 68 run through the rollers and are rotatably mounted in the supporting housing 69 and are directly coupled to the brakes, thus eliminating belt or chain drives.

Mounted to the rear end of the ramp is a bar 77 extending forwardly through a central tube 78 located within the housing 69; a bearing 79 being positioned at each end of the tube to receive the bar. The tube 78, bearings 79 and bar 77 act to keep the housing from skewing during movement of the housing to shift the rollers forward under the wheelchair as later explained.

Considering FIG. 15, the occupant 81 of a wheelchair 82 manually moves the wheelchair rearwardly to back the large drive wheels 83 of the chair onto the forward entrance portion 13 of the ramp with the drive wheels passing over the dolly 26 without releasing it from its forward locked position. It will be noted that the caster capture plates 36 are initially manually moved to their outermost positions before the wheelchair approaches the device. The inner surfaces 84 of the drive wheels 83 of the wheelchair will engage the angled rods 49, acting to urge the rods and the caster capture plates 36 inwardly to the correct position to receive the casters 85 which are located at the forward portion of the chair in a swiveling mode. It should be noted that the dolly 26 is stationarily positioned at the forward portion of the ramp resting against a shoulder 86 formed at the intersection of the ramp base 12 with the inclined forward portion 13. Further movement of the chair brings the casters 85 into alignment with and settling into the openings 42 in the inserts 41 to engage the cable 50 and withdraw the spring-loaded pins 54 from their holes in rails 33 and allow rearward movement of the dolly 26 (see dotted outline of FIG. 15).

Figure 9:
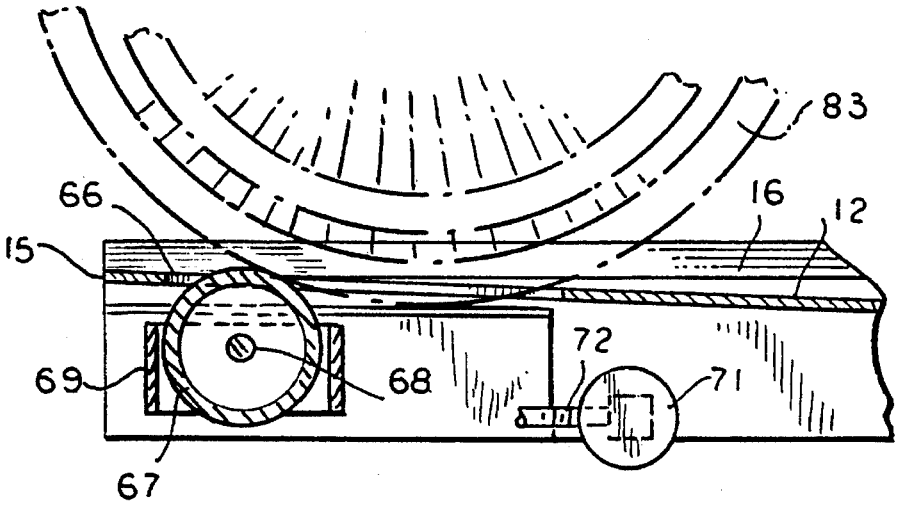
FIG. 9 is a vertical cross sectional view taken on the irregular line 9—9 of FIG. 7.
Figure 10:
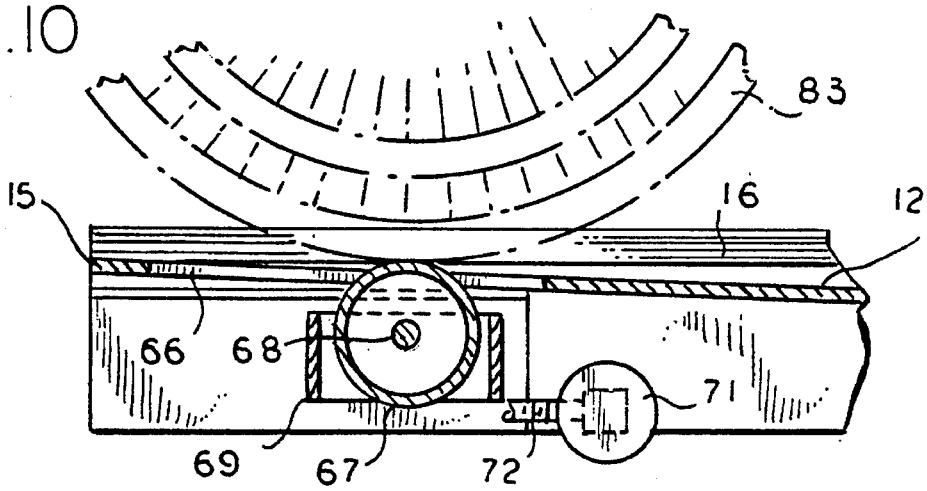
FIG. 10 is a vertical cross sectional view similar to FIG. 9 but showing the rollers in their operative position.
Figure 11:
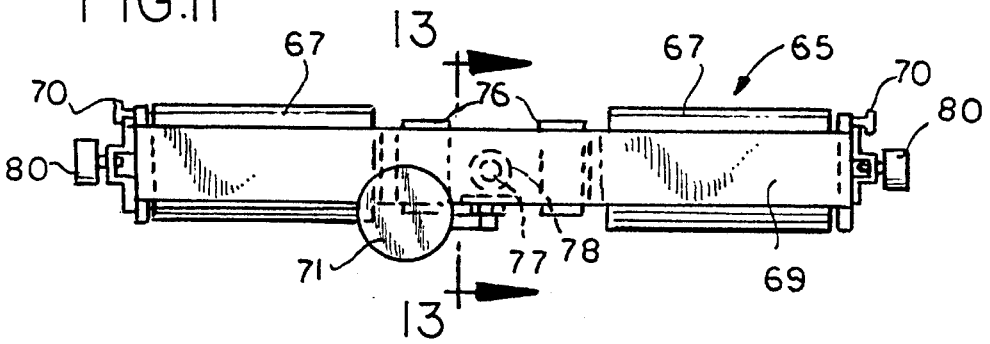
FIG. 11 is a front elevational view of the roller assembly of FIG. 8.
Figure 12:
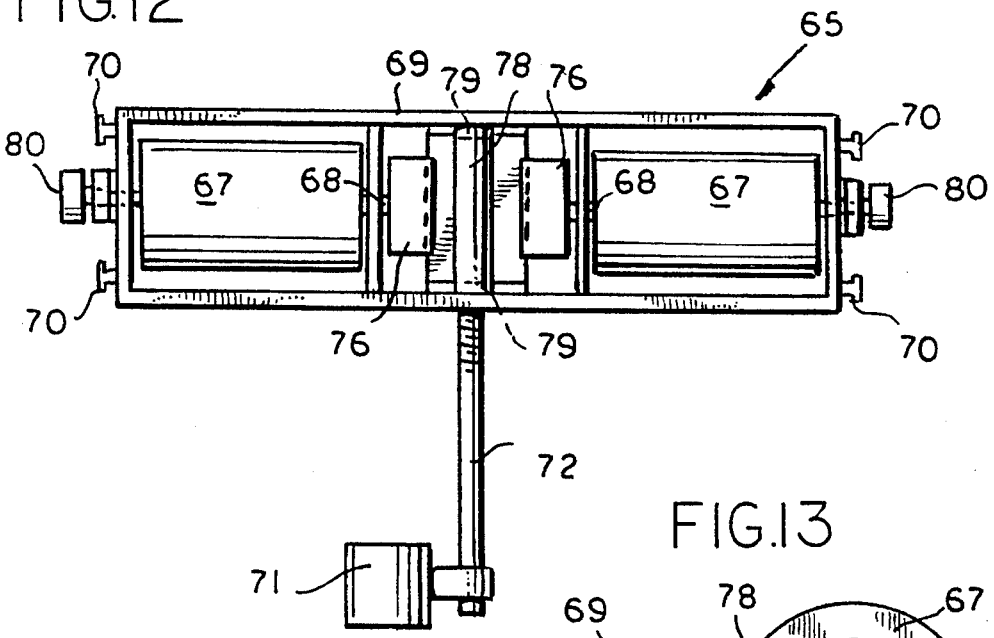
FIG. 12 is a top plan view of the roller assembly.

Additional manual movement of the wheelchair by the occupant will move the wheelchair and dolly 26 to the position of FIG. 16 with the rear drive wheels 83 received partially within the enlarged openings 66 and resting on the exposed surfaces of the retracted rollers 67. Due to the design of the rails 33, the dolly 26 moves with the casters and, upon reaching the horizontal portion 33*a*, lifts the casters to orient the wheelchair in a horizontal position. Actuation by a button or key on the controls or computer 21 activates the piston 61 and cylinder 62 to rotate the toothed arms 57 at each side of the ramp to project through the slots 59 in the base 12 (see FIG. 2) to engage the toothed racks 56 mounted on the side plates 27 of the dolly 26 and lock the dolly, and thus the wheelchair, in operative position on the ramp with the drive wheels resting in the openings 66. As seen in FIG. 9, the housing 69 and rollers 67 are retracted to a position adjacent the rear edge 15 but contacting the drive wheels 83 of the wheelchair. Actuation by a second button or key on the controls or computer actuates the motor 71 rotating the threaded shaft 72 to longitudinally drive the threaded tube 73 to move the roller assembly to a central position within the large openings 66 and slightly lift the drive wheels 83 of the wheelchair out of the openings; the axes of the rollers and drive wheels being substantially vertically aligned. Thus, the drive wheels are solely in contact with the rollers 67 for the actuation of the stress testing or aerobic exercise mode of the device.

The roller openings 66 in the back section of the ramp 11 along with the roller system provide a centering mechanism for wheelchair drive wheels of varying diameters over the rollers. The two rollers 67 are of a significant diameter to eliminate the necessity for adjustment of varying drive wheel diameters as well as varying cambers. The single roller design is made feasible by holding the wheelchair stationary and moving the rollers 67 under the chair. It also allows designers to achieve a lower rolling resistance than that found with the previously used three-roller configuration. This design requires only four bearings and two rollers rather than twelve bearings and six rollers of previous designs.

A magnetic particle brake 76 is incorporated on each roller shaft 68, providing a braking resistance proportional with brake input voltage and independent of roller speed. Each roller shaft 68 runs through the roller 67 and supporting housing 69 and is directly coupled to the brake 76 and an optical encoder 80 (for measurement of direction and velocity) thus eliminating belt or chain drives. The roller widths and lateral spacing have been chosen to accommodate the majority of wheelchair wheelbases and camber angles. A linear actuator (motor 71, shaft 72 and tube 73) is used to locate the rollers in the engaged and disengaged positions.

The caster capture plates 36 on the dolly 26 have been designed to quickly accommodate casters between five and eight inches in diameter. The system can also be modified without significant difficulty to accommodate smaller diameter casters and tricycle configuration wheelchairs. The capture plates 36 ride on the dolly 26 supported by the rails 33 attached to the ramp sides 16. Cam followers 29 and 35 are connected to the side plates 27 of the dolly and are configured to resist any skewing caused by asymmetrical propulsion of the wheelchair drive wheels while the user or occupant is mounting the system. The dolly's primary function is to keep the drive wheels properly positioned over the rollers by incorporating a locking system which holds the dolly stationary during the exercise period. This system is interlocked with the linear actuator used to locate the rollers under the wheelchair drive wheels to ensure the dolly is locked in place prior to engaging the rollers.

The electronics/instrumentation system 21 consists of a 110 VAC power strip which provides power for the computer CPU, the computer monitor, the linear actuator and the power supply. The power supply provides power for an amplifier, which generates the control signals for the right and left brakes 76 and power for the right and left optical encoders 80. One optical encoder is incorporated on each roller shaft 68 to provide both roller speed and directionality information to the CPU. A D.C. motor/tachometer is an alternative to the optical encoder where the D.C. motor can be used to measure velocity and direction (forward or reverse). A control module connects a CPU port to the amplifier controlling the right and left brakes. It also connects the right and left encoders to the CPU via the port; the CPU controls the left and right brakes independently via the software. The control module provides the necessary D/A conversion between the CPU and the amplifier controlling the brakes. The control module also provides the necessary interface between the left and right encoders and the CPU.

The computer software consists of three programs; the user exercise program, the calibration program and the user data management program. The user exerciser program provides feedback to the user with the monitor screen providing information to the user relating to the wheel speeds and target speeds, the wheelchair heading, right and left brake settings, elapsed times, distance traveled both during the current stage and overall and calories burned for the stage and total calories burned.

The present invention provides a number of advantages which are not found in the prior art devices:

1. The ramp system in combination with the roller system provides a self-centering mechanism for properly positioning wheelchairs with varying drive wheel diameters, track widths and drive wheel camber.
2. The ramp system provides a solid base on which the wheelchair occupant can propel his/her wheelchair.
3. The ramp system utilizes a single ramp and does not require a kneeling function for access/egress.
4. The ramp system provides the necessary surfaces for securing and leveling the dolly track system, so that the wheelchair sits horizontally when in the exercising position.
5. The roller system utilizes two single and independent rollers, one for each drive wheel, and is designed to automatically accommodate wheelchairs with varying drive wheel diameters, track widths and drive wheel camber with as few parts as possible.
6. The roller system in combination with the ramp system provides a self-centering mechanism for varying wheelchair geometries by capturing the drive wheels in a pocket, locking the wheelchair in position and then moving a roller forward under each drive wheel. The self-centering mechanism thus allows the wheelchair drive wheel axles to be properly aligned over the roller axles despite varying wheelchair track widths, drive wheel diameters and wheelbases.
7. The caster dolly system provides a self-aligning caster capture mechanism which accommodates different caster diameters and widths.

We claim:

1. An exercise device for a manually operated wheelchair having a pair of rear drive wheels, comprising a ramp with an inclined base extending between a rear edge and an entrance portion for reception of an occupant occupied wheelchair, a pair of openings adjacent the rear edge of the ramp for partially receiving a respective drive wheel of said wheelchair, a separate and independent roller located in each opening, each roller acting to provide contact and support with a respective drive wheel, each of said rollers being movable between a retracted inoperative position and an operative position raising one of said drive wheels at least partially out of its respective opening.

2. An exercise device as set forth in claim 1, in which said openings and rollers act to automatically position the drive wheels for rotation about an axis which is vertically aligned with the axis of rotation of said rollers.

3. An exercise device as set forth in claim 1, in which each said roller is mounted on an independent shaft below said ramp, and a longitudinally shiftable housing for said rollers, said shafts being mounted for free-wheeling in said housing.

4. An exercising device as set forth in claim 1, wherein each said roller has a diameter in the range of 6 to 8 inches.

5. An exercising device as set forth in claim 1, in which each said roller shaft includes a magnetic particle brake and an optical encoder mounted thereon.

6. An exercising device as set forth in claim 3, in which said housing is shifted by a linear actuator comprising a motor and a pair of internally and externally threaded shafts driven by the motor and attached to the housing.

7. An exercise device as set forth in claim 6, in which said housing includes a central tube extending through the housing and having a bearing at each end of the tube, and a bar attached to the rear wall of the ramp and extending into and through said central tube and bearings, said bar and tube acting to prevent skewing of the housing during longitudinal movement thereof.

8. An exercise device for a manually operated wheelchair having a pair of rear drive wheels and a pair of front casters, a caster capture system to lock a wheelchair in position on the ramp, said ramp having a generally sloping surface between a rear edge and a forward entrance end, a dolly movable on the ramp between front and rear positions and including means engagable with the wheelchair when the dolly is in the forward position for guiding the wheelchair along the inclined portion when the dolly moves to the rear position.

9. An exercising device as set forth in claim 8, wherein said device includes means for selectively holding the dolly in the rear position.

10. An exercising device as set forth in claim 9, wherein said dolly includes a pair of caster capture plates mounted for lateral movement on said ramp, each plate includes an opening receiving a caster therein prior to movement of the wheelchair up the inclined ramp base to the training position.

11. An exercising device as set forth in claim 8, in which angled rods are attached on said caster capture plates to engage with said drive wheels to adjust the plates to receive the casters of the wheelchair.

12. As exercise device as set forth in claim 8, wherein said dolly includes a pair of spring-loaded plungers cooperating with the sides of the ramp structure, and a cable attached to said spring-loaded plungers and extending through the dolly and under the caster openings wherein said reception of the casters within said openings in the plates retracts the plungers to release the dolly to move onto said inclined portion to the training position.

13. An exercise device as set forth in claim 12, in which said ramp includes a pair of openings receiving a pair of large rollers moving between a retracted position and an operative position, said openings adapted to receive said drive wheels of said wheelchair.

14. An exercise device for manually operated wheelchairs and their occupants comprising a ramp adapted to receive an occupant in a wheelchair having front casters and rear drive wheels, said ramp including a generally flat sloping base, a pair of generally parallel sides and a rear edge, an inclined forward end on said ramp communicating between said ramp base and a supporting surface therefor, a dolly on said ramp longitudinally movable between front and rear positions and having elongated openings receiving said front casters therein, means locking said dolly at its forward position adjacent said inclined forward end of said ramp, means for locking said dolly in its rearward position, a pair of enlarged openings adapted to partially receive said rear drive wheels when said dolly is in its rearward position, and a pair of enlarged rollers beneath said ramp, each roller movable between a retracted position and an operative position within said enlarged opening to engage and support said rear wheels.

15. An exercise device as set forth in claim 14, in which said dolly is formed from a pair of parallel elongated rods extending between said ramp sides, and a pair of laterally movable caster capture plates on said rods containing openings to receive said front casters.

16. An exercise device as set forth in claim 14, in which said dolly includes a pair of outer side plates secured to the ends of said rods, each plate carrying a pair of spaced cam followers, and a rail on each ramp side extending between said ramp forward end and a second position spaced from said rear edge and supporting said cam followers.

17. An exercise device as set forth in claim 16, in which said first mentioned dolly locking means comprises a cable extending across said dolly and having a spring-loaded pin at each end projecting through said side plates into openings in said rails.

18. An exercise device as set forth in claim 15, wherein said dolly includes an angled adjustment rod attached to each laterally movable caster plate and adapted to engage said drive wheels and laterally shift the caster plates to align the front caster openings with said front casters.

19. An exercise device as set forth in claim 18, wherein said angled rod includes a forwardly projecting portion terminating in an angled outer end adapted to engage the interior surface of a wheelchair drive wheel.

20. An exercise device as set forth in claim 17, in which said cable extends underneath said dolly and across said caster capture openings so that said front casters, when received in the plate openings, depress said cable and retract said spring-loaded pins to unlock said dolly.

21. An exercise device as set forth in claim 15, wherein each caster capture plate includes depending ears having openings receiving said parallel rods so that the plates move laterally smoothly along said rods.

22. An exercise device as set forth in claim 14, wherein said forward entrance end of said ramp is formed with a shoulder defining the intersection between said ramp and said forward end, said shoulder acting to limit forward movement of said dolly.

23. An exercise device as set forth in claim 14, wherein said second mentioned locking means for said dolly includes a toothed plate on each side plate and a pivotally mounted toothed arm beneath said ramp rotatable into a position projecting through said ramp base to engage said toothed plate, and means to actuate said arm.

24. An exercise device as set forth in claim 23, wherein said actuating means comprises a cylinder mounted beneath said ramp and a piston within said cylinder and pivotally engaging a lever connected to a pivot rod extending beneath said ramp, said lever and toothed arm being secured to said rod for rotation therewith.

25. An exercise device as set forth in claim 24, wherein said piston and cylinder are activated by control means mounted on said ramp.

26. An exercise device as set forth in claim 14, wherein said rollers include a pair of roller shafts, each shaft supporting a roller, a magnetic particle brake and an optical encoder, and a roller housing for each roller and shaft and movable between a rearward inactive position and a forward engaged position.

27. An exercise device as set forth in claim 26, wherein a motor is mounted beneath said ramp and rotates a threaded shaft, and an internally threaded tube received on said shaft to engage said threads and connected to said roller housing for the pair of rollers.

28. An exercise device as set forth in claim 26, wherein said single roller system acts to eliminate adjustment for varying drive wheel diameters and cambers.

29. An exercise device as set forth in claim 14, including a control system for said device mounted on a swingable arm at one side of said ramp, said control system being connected to said piston and cylinder for said rack, said motor for said rollers, and said magnetic particle brake and optical encoder.

30. An exercise device as set forth in claim 14, wherein said device allows an occupant of a wheelchair to back the wheelchair up onto said inclined forward end with the wheelchair drive wheels passing over said dolly until said wheelchair front casters engage and rest within said caster openings in laterally movable caster capture plates, said first mentioned locking means including a pair of spring-loaded locking pins and a cable extending between and acting to retract said pins, seating of said front casters releasing said first mentioned locking means, said dolly moving rearward with said wheelchair until said drive wheels rest in said enlarged openings adjacent said rear abutment, said occupant then activating a pivotal toothed arm to engage toothed plates on said dolly to lock the dolly in its rearward position and a motor to move the rollers from their retracted position to a forward position wherein said rollers engage and lift said wheelchair drive wheels so that activity can begin.

* * * * *